US010160017B2

(12) United States Patent
Matsunaga

(10) Patent No.: US 10,160,017 B2
(45) Date of Patent: Dec. 25, 2018

(54) TORQUE BALANCING ROLL FORMING MACHINE

(71) Applicant: Braner USA, Inc., Schiller Park, IL (US)

(72) Inventor: Douglas S. Matsunaga, Mettawa, IL (US)

( * ) Notice: Subject to any disclaimer, the term of this patent is extended or adjusted under 35 U.S.C. 154(b) by 207 days.

(21) Appl. No.: 14/996,341

(22) Filed: Jan. 15, 2016

(65) Prior Publication Data

US 2017/0203347 A1 Jul. 20, 2017

(51) Int. Cl.
*B21B 37/46* (2006.01)
*B21B 35/14* (2006.01)

(52) U.S. Cl.
CPC ..... *B21B 37/46* (2013.01); *B21B 35/14* (2013.01)

(58) Field of Classification Search
CPC ..... B21B 31/10; B21B 31/103; B21B 35/14; B21B 37/46; B21B 37/52; B21B 2031/023; B21D 5/06; B21D 5/12
See application file for complete search history.

(56) References Cited

U.S. PATENT DOCUMENTS

| | | | | | |
|---|---|---|---|---|---|
| 2,334,886 | A * | 11/1943 | Siegerist | B21C 37/30 | 72/99 |
| 2,565,565 | A * | 8/1951 | Landau | B29B 7/586 | 72/232 |
| 3,683,653 | A * | 8/1972 | Cox | B21B 37/46 | 72/10.2 |
| 3,945,232 | A * | 3/1976 | Colbath | B21D 5/06 | 72/181 |
| 4,212,218 | A | 7/1980 | Braner et al. | | |
| 4,327,620 | A | 5/1982 | Greinke et al. | | |
| 5,007,272 | A | 4/1991 | Matsunaga et al. | | |
| 5,158,002 | A | 10/1992 | Matsunaga et al. | | |
| 5,450,740 | A * | 9/1995 | Lovinggood | B21B 31/10 | 72/181 |
| 5,823,036 | A * | 10/1998 | Matsunaga | B21B 31/103 | 72/181 |
| 6,438,819 | B1 * | 8/2002 | McGlinchy | B21D 5/08 | 29/414 |
| 2013/0239638 | A1 * | 9/2013 | Ma | B21B 19/02 | 72/206 |

* cited by examiner

*Primary Examiner* — Pradeep C Battula
(74) *Attorney, Agent, or Firm* — Botkin & Hall, LLP

(57) ABSTRACT

A roll forming machine is provided having a series of mill stands, each having an upper roller and a lower roller that performs a roll forming step. The upper roller rotates on a central axis that is parallel to the lower roller. Each roller has a driven feature that connects to a driving feature. The driving feature for the upper roller can rotate independently from the driving feature of the lower roller. A control system is capable of monitoring, controlling, and displaying the individual torque and speed of separate motors that rotate the individual driving features.

19 Claims, 6 Drawing Sheets

TORQUE BALANCING ROLL FORMING MACHINE

BACKGROUND OF THE INVENTION

This present disclosure relates to roll forming machines, specifically how the individual stations are driven. Each station has an upper roller and a lower roller that pinch the material to progressively shape it. Each roller must be rotationally driven to move the material along and assist the forming. Currently, the stations are all driven from one power source, commonly an electric motor. The shaft of the electric motor is affixed to a single gearbox, where the rotation from the motor is then divided up and split up into several output shafts, each driving a roller. For example, in U.S. Pat. No. 5,450,740, one gearbox drives several rollers. Because of slightly different speeds of both upper and lower rollers, along with slightly different speeds of the rollers from station to station, a fixed gearbox that provides the exact same rotational speed to each roller, binding and torque spikes can occur. Further, windup (where a biased torque builds up between two rotating members) causes uneven load, rapid tooling wear, roll scuffing of the material, and possibly catastrophic failure of the gearbox. An improved roll former and driving mechanism are needed.

SUMMARY OF THE INVENTION

The present disclosure describes an improvement to a roll former. As is known in the art, roll formers have a series of rollers. In this invention, each roller is driven independently, allowing significant flexibility in tooling and appropriate speed settings from roller to roller and station to station. Instead of a traditional gearbox arrangement, individual motors (electric or hydraulic) drive individual rollers. As is typical of a roll former, the individual output shafts of the motors are coupled to the rollers through shafts with flexible joints on each end. Frequently, each motor has its own gearbox to reduce the output speed and increase torque output, as roll forming lines can run slower than an optimum motor rotational speed. As material is fed into the machine, the operator can tailor speed and torque unique to each roller to optimize the process and reduce wasted power. The invention provides significant benefits over the prior art.

BRIEF DESCRIPTION OF THE DRAWINGS

A preferred embodiment of this invention has been chosen wherein.

DESCRIPTION OF THE PREFERRED EMBODIMENT

As is known in the art, a roll forming machine takes a flat strip of material and shapes it into a continuous cross-sectional desired shape, such as tubing. Frequently, the roll forming machine is a portion of a production line where the flat strip is provided to the machine from another machine, such as an uncoiler or slitter. After the machine makes the tubing, the tubing may be finished by other processes, such as cutting, end finishing, and stacking. This specification is primarily dedicated to the machine portion of the production line.

Figure 4:
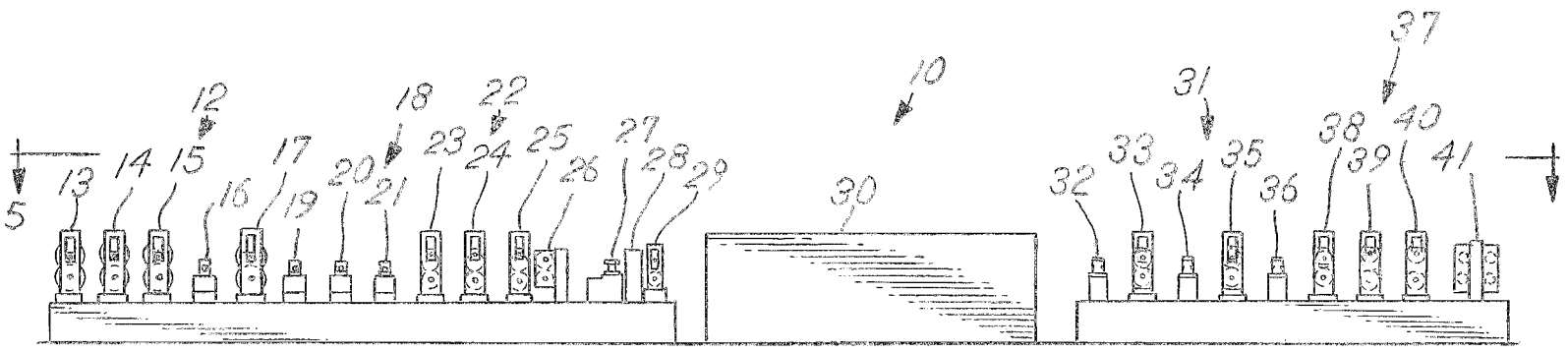
FIG. 4 is a side view of the roll forming machine.
Figure 5:
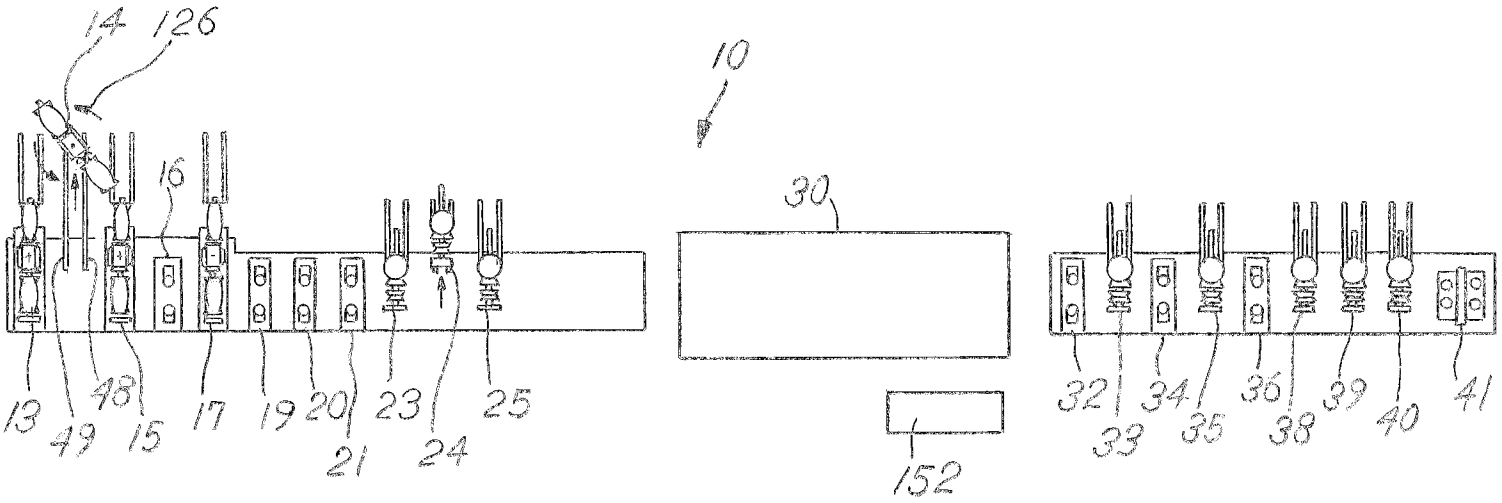
FIG. 5 is a top view of the roll forming machine of FIG. 4.

Referring first to the drawings of FIGS. 4 and 5, reference numeral 10 generally designates a roll forming line, commonly used in making cylindrical tubes from sheet metal products. As shown in FIG. 4, a typical line 10 includes numerous machines which form the various sections of the line. These include forming section 12, which includes mill stands 13, 14, 15, 16 and 17; a cluster section 18 which includes mill stands 19, 20 and 21; a finishing section 22 which includes mill stands 23, 24, 25 and 26; a welding section which includes mill stands 27, 28 ad 29; a cooling section 30; a sizing section 31 which includes mill stands 32, 33, 34, 35 and 36; and a squaring section 37 which includes mill stands 38, 39, 40 and 41. Sheet steel enters the line 10 from an uncoiler (not shown) at forming section 12 and exits line 10 after passing through squaring section 37. Line 10 roll gradually forms flat sheet steel into cylindrical tubes, which are cut to specified lengths after exiting the squaring section 37.

The general process by which cylindrical tubing is formed from flat sheet steel is well-known and will not be described in detail in the interests of clarity. Generally, it is preferable if at least mill stands 13, 14, 15, 17, 23, 24, 25, 33, 35, 38, 39 and 40 are constructed according to the principles of this invention. Since the construction of these mill stands is generally the same, a detailed description will be provided only for mill stand 13 with the understanding that this general construction will apply to all affected mill stands which utilize the principles of this invention.

Figure 1:
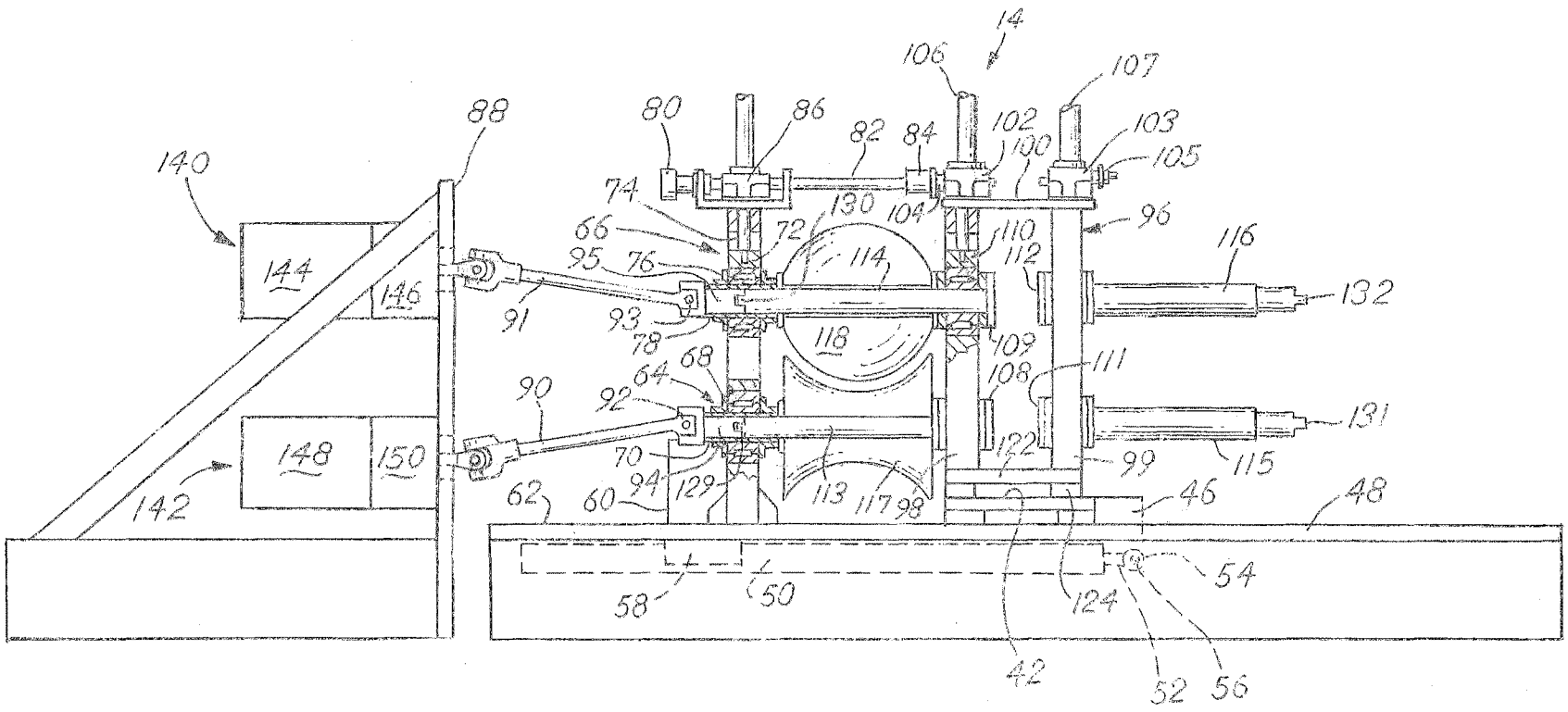
FIG. 1 is a front view of one station of the roll forming machine with portions shown in section to illustrate the arbor connections.

As an example, mill stand 14 is shown in elevation in FIG. 1, and illustrates the working position of the mill stand. Mill stand 14 includes main support frame 42 which includes spaced rail coupling brackets 46 (one shown) located on both sides of the support frame 42. Frame 42 is supported above slide rails 48, 49 by brackets 46 which slidably connect the frame to the rails for relative sliding movement between the work position of FIG. 1 and the retracted standby and changeover positions of FIGS. 2 and 3.

Power driven cylinder 50, typically a hydraulic cylinder having an extensible push rod 52 is fixedly secured to rails 48, 49 or to bracket 58 of drive frame 60 as shown. A lower connecting bracket 54 of frame 42 is connected to the terminal end of push rod 52 as by bolt 56 to allow for linear translation of movement between the push rod 52 and bracket 54.

Upright drive frame 60 is fixed to support table 62 by conventional means. Drive frame 60 carries spaced bearing blocks 64, 66. Lower bearing block 64 is fixedly connected to drive frame 60 and includes collar 68 and sleeve 70. Upper bearing block 66 is adjustably connected to drive frame 60 as by block 72 and jackscrew 74 and also has a collar 76 and sleeve 78. Motor 80 is supported atop drive frame 60 and includes rotatable drive shaft 82 which terminates in coupler 84. Drive shaft 82 extends through gear box 86 which is mechanically connected to jackscrew 74 so as to translate rotational movement of the drive shaft 82 into rotational movement of the jackscrew 74, and corresponding linear movement of bearing block 66.

As shown in FIG. 1, motor assemblies 140, 142 are attached to a driving frame 88. The upper motor assembly 140 has an upper motor 144 and a gearbox 146 that is associated only with its corresponding motor 144. As shown, the upper motor 144 is affixed to the gearbox 146, which is then affixed to an upper drive shaft 91. The lower motor assembly 142 has a lower motor 148 and a gearbox 150 that is associated only with its corresponding motor 148. As shown, the lower motor 148 is affixed to the gearbox 150, which is then affixed to a lower drive shaft 90. Both drive shafts 90, 91 extend from driving frame 88 and are connected via universal joints 92 and 93 respectively and driving features 94, 95 to bearing blocks 66 and 64. Driving features 94 and 95 extend into a respective sleeve 78, 70 of bearing blocks 66, 64 respectively. The driving features 94, 95 are rotatable within the sleeves 78, 70.

Frame 42 supports arbor frame 96 which includes spaced upright turrets 98 and 99. Plate 100 serves to connect turrets 98 and 99 and supports gear boxes 102 and 103. Gear boxes 102, 103 are used to drive height adjustment of upper arbors 114, 116. Couplings 104, 105 respectively are connected to and extend from gear boxes 102, 103. Jackscrews 106 and 107 extend through and are mechanically connected to gear boxes 102, 103 for translational movement.

Outboard housing turret 98 carries and supports bearing blocks 108, 109. Bearing block 108 is fixedly connected to turret housing 98 and is generally aligned with bearing block 64. Bearing block 109 is vertically adjustable and is connected to turret 98 as by block 110 connected to jackscrew 106. Turret 99 supports bearing blocks 111 and 112 in a similar fashion.

A first pair of rotatable arbors 113 and 114 is carried in bearing blocks 108 and 109. A second pair of arbors 115 and 116 is rotatably housed in bearing blocks 111 and 112. Forming rollers 117 and 118 are carried by and supported on arbors 113 and 114 respectively. The configuration and size of rollers 117, 118 will depend upon the predetermined size and desired shape of pipe to be formed, and by the position of the particular mill stand 13 in line 10. Since sheet steel is gradually bent to form pipe, the rollers 117, 118 will vary slightly in configuration as the line 10 progresses. The basic process of forming pipe from sheet steel is well known and does not form part of this invention. Collars 120 serve to secure rollers 117, 118 to arbors 113, 114 to prevent relative movement therebetween. In the embodiment shown, rollers 117 and 118 rotate along with arbors 113, 114 with no relative rotation taking place.

Arbor frame 96 includes a lower table 122 which is rotatably supported atop frame 42 as by bearing 124. Drive means (not shown) is connected to table 122 and serves to rotate the table about a vertical axis.

Arbors 115 and 116 are also adapted to carry rollers (shown in dotted line form) 127, 128. The construction of arbors 115, 116 is the same as arbors 113, 114. Each arbor 113-116 includes a driven feature 129, 130, 131, 132 which mates with driving feature 94 or 95, depending upon the position of the arbor, when the arbor frame 96 is in the work position.

Figure 2:
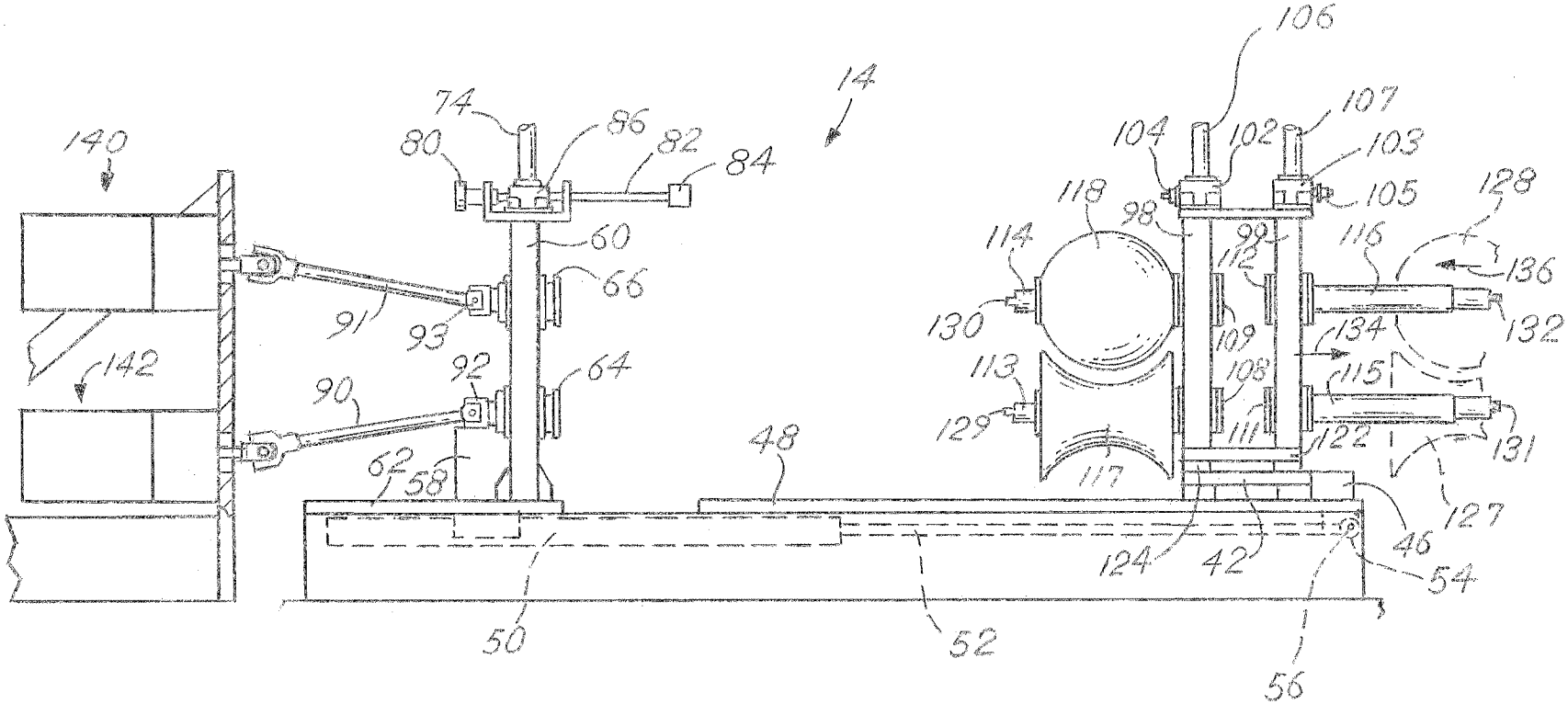
FIG. 2 is a front view of the station in FIG. 1 with the upper and lower rollers disengaged from the arbor connections.
Figure 3:
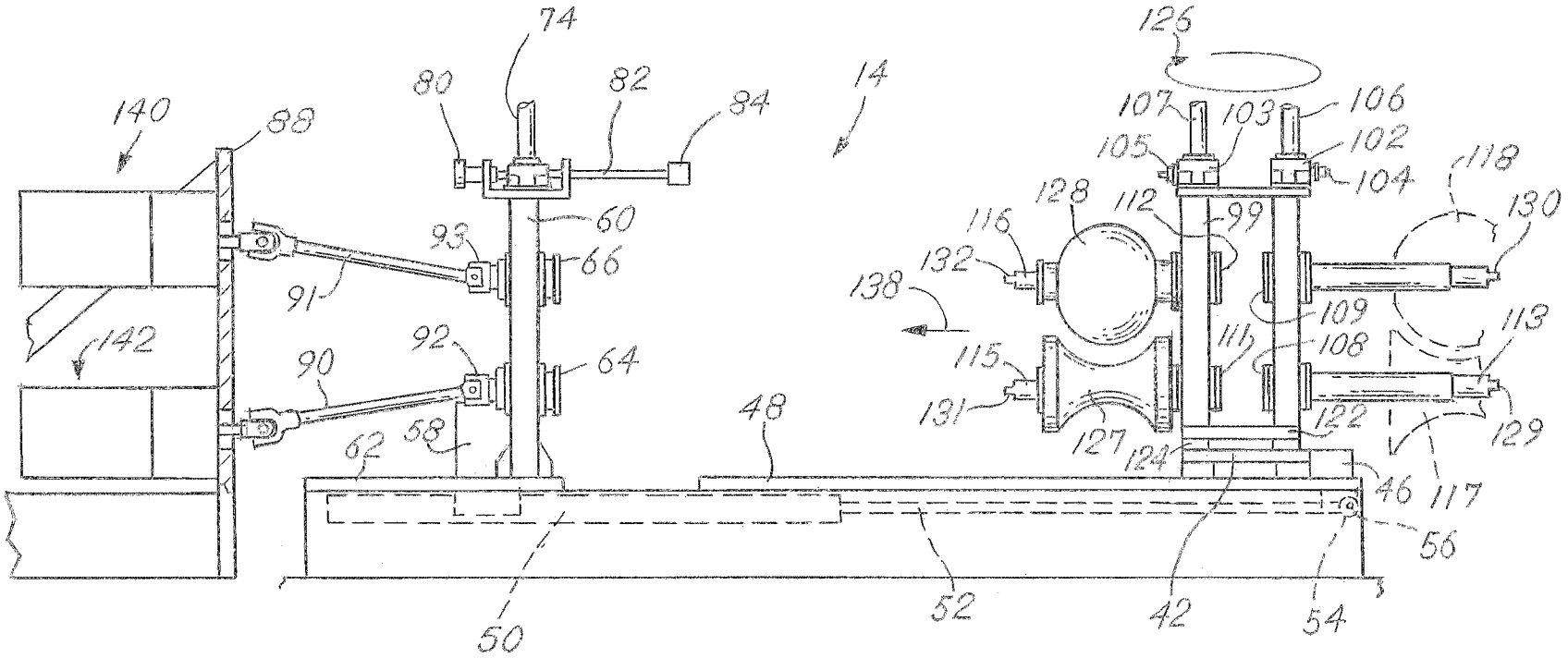
FIG. 3 is a front view of the roll forming machine of FIG. 2 with the movable portion of the mill stand rotated.

FIGS. 1-3 illustrate the functionality and operation of mill stand 14. Because of the many variations in wall thickness and pipe sizes, roll forming companies must often change the rollers used in a given line. Also, due to manufacturing considerations, each mill stand is positioned relatively close to an adjacent stand to prevent slack from developing in the steel as it passes through the line, as shown in FIG. 5. The relatively close positioning of mill stands prevents on-line changing of rollers without physically removing the individual mill stands from the pass line.

Mill stand 14 is shown in the working or on-line position in FIG. 1. In this position, push rod 52 is fully retracted in cylinder 50, and each working arbor 113, 114 has its driven feature 129, 130 in mating engagement with driving features 94, 95 of drive shafts 90, 91. Also, screw drive shaft coupler 84 engages coupling 104 which mechanically connects jackscrews 74 and 106 to equalize vertical shifting of bearing blocks 66 and 109, if adjustment is required.

Figure 6:
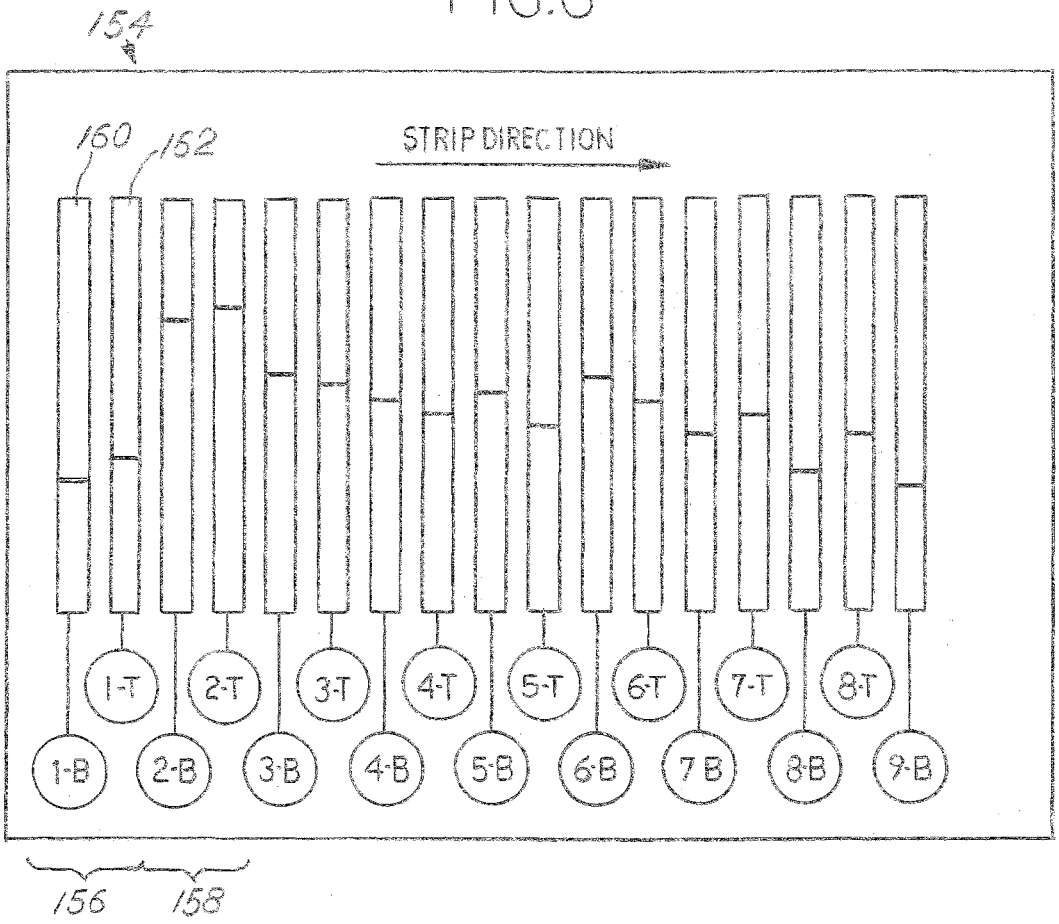
FIG. 6 is a view of the display panel showing individual torque for each roller.

During operation, rotational movement of drive shafts 90, 91 rotates vertically spaced adjacent arbors 113, 114 and rollers 117, 118 that are fixed on their corresponding arbors 113, 114. Sheet steel is passed through the rollers 117, 118 to be bent. As shown in FIG. 5, successive mill stands in the tube line 10 further shape the steel until it emerges in sealed tube form. The upper motor assembly 140 and lower motor assembly 142 are controlled individually and independently by a controller 152. The controller 152 allows independent speed and/or torque control of each motor, either by current monitoring, speed monitoring, or an external torque sensor affixed between the motor 144, 148 and its respective drive shaft 91, 90. As shown in FIG. 6, a monitoring panel 154 controls and displays the torque as supplied by each motor assembly 140, 142. The monitoring panel 154 shows the torque for all of the individual drivers for each station, allowing the user to tailor and balance the load from roller to roller and mill stand to mill stand. An operator can independently control rollers within the same mill stand so that adjacent rollers have different speeds and applied torques. Each mill stand has its own respective display group 156, 158 of torque/speed for the upper and lower roller for each mill stand. The torque/speed for the upper roller 160 and the torque/speed for the lower roller 162 are displayed individually, allowing the operator to adjust each roller independently. As is shown in display group 158, the upper and lower rollers have a higher torque than display group 156. In this case, the operator can balance the load by increasing the torque for display group 156 and reducing the torque for display group 158.

When it is time to change rollers, such as when different wall thickness or pipe diameter is to be run, mill stand 14 need not be removed from the line 10 by crane, as previously required. FIGS. 2 and 5 illustrate the step of removing mill stand 14 from line 10. Cylinder push rod 52 is extended, and by virtue of its connection to bracket 54, frame 42 slides along rails 48, 49 in the direction of arrow 134 until the full off-line position is reached as shown. Preferably, the rollers 127, 128 (shown in dotted line form in FIG. 2, and in solid lines in FIG. 3) are already secured to standby arbors 115, 116 (see arrow 136) so as to further reduce changeover time and to reduce the downtime of line 10.

Arbor frame 96 is then rotated as indicated by arrow 126 to bring the standby arbors 115, 116 and rollers 127, 128 into the working alignment shown in FIG. 3. Cylinder push rod 52 is then retracted to slide arbor frame 96 towards drive frame 60 (arrow 138) until driven features 131, 132 engage driving features 94, 95 as before described. Vertical adjustments are again performed by rotation of jackscrews 74, 107. Rollers 117, 118 secured to standby arbors 113, 114 may be removed and replaced if necessary.

The above procedure is carried out for each mill stand along line 10 which requires that different rollers be used. By providing for the shiftable mill stands and rotatable turret heads, changeover and down time is significantly reduced with no loss in accuracy of roller settings. Further, the differential speed control of each of the rollers in the separate mill stands provides tailored control and reduced stress on the drive mechanism.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A roll forming machine comprising:

a mill stand supported by a lower frame portion and having a lower arbor carried within, said mill stand having an upper arbor carried within, each of said arbors having a driven feature to rotate said arbors about its corresponding central axis;

a drive frame having an upper and lower motor, each of said motors having a corresponding fixed housing portion being fixed with respect to said drive frame, said upper motor having a driving feature being rotatable with respect to said corresponding fixed housing portion, said lower motor having a driving feature being rotatable with respect said corresponding fixed housing portion, each of said driving features to provide rotational torque to a corresponding said driven feature; and a controller in communication with said upper and lower motor, said controller independently rotating and controlling a torque for said upper motor with respect to said lower motor, said controller in communication with a display panel.

2. The roll forming machine of claim 1, each of said motors being comprised of an electric motor coupled to said gearbox.

3. The roll forming machine of claim 2, each of said motors and gearboxes affixed to a second frame being spaced from said drive frame, an output shaft of said gearbox coupled to a driveshaft to transmit torque to a corresponding said driving feature.

4. The roll forming machine of claim 3, said controller having a display to display individual torque of said electric motors.

5. A roll forming machine comprising:

a lower frame;

a drive frame having a first driving feature being rotatably held within said drive frame, said drive frame having a second driving feature being rotatably held within said drive frame;

a first motor assembly being connected to said first driving feature for rotating said first driving feature and a second motor assembly being connected to said second driving feature for rotating said second driving feature, said first motor assembly and first driving feature independently rotatable with respect to said second motor assembly and said second driving feature;

a controller independently controlling torque and rotation of said first motor assembly separately from said second motor assembly;

an arbor frame shiftably supported upon said lower frame and located opposite said drive frame;

a pair of arbors rotatably supported in an arbor frame at a proximal end and having a distal end opposite said proximal end, a first arbor of said pair being spaced from a second arbor of said pair, said first arbor having a first driven feature mateable with said first driving feature, said second arbor having a second driven feature mateable with said second driving feature.

6. The roll forming machine of claim 5, said driven feature engages said driving feature in a complementary manner and a second position wherein said driven feature and said driving feature are spaced apart.

7. The roll forming machine of claim 6 and an actuator for shifting said arbor frame with respect to said drive frame.

8. The roll forming machine of claim 7, wherein said actuator being a hydraulic cylinder.

9. The roll forming machine of claim 8, including rails upon which said arbor frame is in slidable contact therewith.

10. The roll forming machine of claim 5, each of said motor assemblies being comprised of an electric motor coupled to a gearbox.

11. The roll forming machine of claim 10, each of said motors and said gearboxes affixed to a second frame being spaced from said drive frame, an output shaft of said gearbox coupled to a driveshaft to transmit torque to a corresponding said driving feature.

12. The roll forming machine of claim 11, said controller having a display to display individual torque of said driving features.

13. A roll forming machine comprising:

a lower frame and a drive frame fixed with respect to said lower frame;

a pair of driving features being rotatably held within said drive frame, one of said driving features being independently rotatable with respect to the other of said driving features, each of said driving features being connected to a corresponding motor assembly rotatably driving said driving featured connected thereto;

an arbor frame shiftably supported by said lower frame and located opposite said drive frame;

a pair rotatable arbors rotatably supported in said arbor frame and spaced from each other, said arbors having a driven feature for mating with a corresponding said driving feature, said arbors located between said arbor frame and said drive frame, said arbor frame shiftable between a first position wherein said driven feature engages said driving feature in a complementary manner and a second position wherein said driven feature and said driving feature are spaced apart, each of said driving features independently providing torque to a corresponding rotatable arbor; and a controller controlling said torque of each of said motor assemblies independently, said controller in communication with a display panel, said display panel displaying said torque from each of said motor assemblies separately to said corresponding rotatable arbor.

14. The roll forming machine of claim 13, said display panel adjusting said controller.

15. The roll forming machine of claim 13, and an actuator for shifting said arbor frame with respect to said drive frame, said actuator being a hydraulic cylinder.

16. The roll forming machine of claim 15 including rails upon which said arbor frame is in slidable contact therewith.

17. The roll forming machine of claim 13, each of said motor assemblies being comprised of an electric motor coupled to a gear box.

18. The roll forming machine of claim 17, each of said motors and said gearboxes affixed to a second frame being spaced from said drive frame, an output shaft of said gearbox coupled to a driveshaft to transmit torque to a corresponding said driving feature.

19. The roll forming machine of claim 18, said controller having a display to display individual torque of said motor assemblies.

* * * * *